US007368418B2

(12) United States Patent
Diamond et al.

(10) Patent No.: US 7,368,418 B2
(45) Date of Patent: May 6, 2008

(54) LAUNDRY COMPOSITIONS

(75) Inventors: Harold Diamond, Alpine, NJ (US); Joshua Schwarz, Wesley Hills, NY (US)

(73) Assignee: Diamond Chemical Company, Inc., East Rutherford, NJ (US)

( * ) Notice: Subject to any disclaimer, the term of this patent is extended or adjusted under 35 U.S.C. 154(b) by 0 days.

(21) Appl. No.: 11/026,137

(22) Filed: Dec. 30, 2004

(65) Prior Publication Data

US 2005/0170986 A1 Aug. 4, 2005

Related U.S. Application Data

(63) Continuation-in-part of application No. 10/307,561, filed on Dec. 2, 2002, now abandoned.

(51) Int. Cl.

| | |
|---|---|
| ***C11D 17/06*** | (2006.01) |
| ***C11D 3/06*** | (2006.01) |
| ***C11D 3/10*** | (2006.01) |
| ***C11D 3/395*** | (2006.01) |

(52) U.S. Cl. ..... 510/276; 510/309; 510/375; 510/378; 510/506; 510/509; 510/510; 510/108

(58) Field of Classification Search ..... 510/309, 510/375, 378, 506, 509, 108, 276, 510
See application file for complete search history.

(56) References Cited

U.S. PATENT DOCUMENTS

| | | | | |
|---|---|---|---|---|
| 2,338,798 A | | 1/1944 | Borglin | |
| 4,276,312 A | | 6/1981 | Merritt | |
| 4,561,991 A | * | 12/1985 | Herbots et al. | 510/281 |
| 5,602,090 A | | 2/1997 | Melikyan et al. | |
| 5,614,484 A | * | 3/1997 | Panandiker | 510/102 |
| 5,691,293 A | * | 11/1997 | Kruse et al. | 510/224 |
| 6,143,707 A | * | 11/2000 | Trinh et al. | 510/220 |
| 6,316,399 B1 | | 11/2001 | Melikyan et al. | |
| 6,333,301 B1 | | 12/2001 | Kamiya | |
| 6,451,339 B2 | | 9/2002 | Patel et al. | |
| 6,462,011 B1 | * | 10/2002 | Collins et al. | 510/437 |
| 6,706,676 B2 | | 3/2004 | Swensen | |
| 2002/0107149 A1 | | 8/2002 | Volgas et al. | |
| 2002/0169091 A1 | | 11/2002 | Clare et al. | |
| 2004/0224872 A1 | * | 11/2004 | Fine et al. | 510/438 |
| 2004/0242442 A1 | * | 12/2004 | Fine et al. | 510/108 |

FOREIGN PATENT DOCUMENTS

| | | |
|---|---|---|
| GB | 09191 | 4/1913 |

* cited by examiner

*Primary Examiner*—Lorna M. Douyon
(74) *Attorney, Agent, or Firm*—Hoffman & Baron, LLP

(57) ABSTRACT

Cleaning compositions functioning in a unique manner are described. These new compositions provide improved cleaning efficacy for all types of surfaces. In addition, in textile laundry applications these compositions provide superior cleaning efficacy for all types and colors of fabrics, as well as extending the range and types of stains and dirt that commonly can be treated by present day commercial laundry compositions.

6 Claims, No Drawings

LAUNDRY COMPOSITIONS

The present application is a continuation-in-part of U.S. patent application Ser. No. 10/307,561 filed on Dec. 2, 2002, now abandoned herein incorporated by reference in its entirety.

FIELD OF THE INVENTION

The present invention relates to cleaning compositions and, more particularly, to a new class of cleaning compositions that treat stains and oily dirt on colored fabrics, textiles, and hard surfaces.

BACKGROUND OF THE RELATED TECHNOLOGY

Traditionally, cleaning compositions, particularly commercial laundry detergents and soaps available in the marketplace, function as substances that physically remove dirt, soil, and stains from the textile surfaces being cleaned. These commercial detergents and soaps are surface active materials containing surfactants and concentrate at the textile surfaces where the dirt resides. The cleaning surfactants are in equilibrium with like surfactants in the wash cleaning liquid. Simply stated, these surfactants physically incorporate (dissolve) the dirt, oil, or stains in their micelles and then transport them away from the textile surfaces and into the bulk of the cleaning liquid.

The popularity of these commercial soaps and detergents in the marketplace is legendary, and their ability to physically clean textiles is adequate for most common soils and dirt; however, these detergents and soaps are less effective in removing oily soils and/or hydrophobic stains.

Traditionally, a commercial method of chemical cleaning or bleaching is used to remove stains. The actual dirt causing the stain is not physically removed from the surface being cleaned. The dirt is bleached, i.e., chemically altered, to a colorless state.

Typical commercial bleaching agents contain hypochlorites. A hypochlorite is a chemically strong oxidizing agent generally preferred to the weaker hydrogen peroxide. Hypochlorite is effective as a stain-removing bleach, but has a major drawback, viz., it indiscriminately bleaches (i.e., discolors) many colored materials, attacking and altering the fabric color. Thus, in cleaning laundry textiles, commercial hypochlorite bleaches can only be used for white clothing. It should also be noted that the aggressive bleaching nature of hypochlorite weakens the fabric of clothing. Thus, after a number of washings, the treated materials are usually less durable.

In U.S. Pat. Nos. 5,602,090, issued to Melikyan et al. on Feb. 11, 1997 for SURFACTANTS BASED AQUEOUS COMPOSITIONS WITH D-LIMONENE AND HYDROGEN PEROXIDE AND METHODS USING THE SAME, and 6,316,399, issued to Arman V. Melikyan on Nov. 13, 2001 for SURFACTANTS BASED AQUEOUS COMPOSITIONS WITH D-LIMONENE AND HYDROGEN PEROXIDE AND METHODS USING THE SAME, compositions are disclosed suggesting the use of the combination of hydrogen peroxide and terpenes. The description relates to a product incorporating hydrogen peroxide and the hydrophobic terpenes in a liquid composition. The function of this liquid composition is not for the laundering of textiles and fabrics.

In addition, the liquid compositions of the Melikyan patents are not formulated for high pH levels exceeding 9.5, which enhance the bleaching effects of the hydrogen peroxide. These patents teach the requirement of low pH levels to make the liquid combination of terpenes and hydrogen peroxide stable in solution.

SUMMARY OF THE INVENTION

The present invention offers a powerful new approach to cleaning in general and, in particular, to cleaning of colored textiles without harming the fabric. It combines the chemical bleaching of hydrogen peroxide at a higher pH level and one or more solvents to give a vastly superior and efficacious product.

The new laundry compositions of this invention comprise a source of hydrogen peroxide and hydrophobic solvents and/or surfactants in a dry formulation. The removal of difficult hydrophobic or oil-based stains from surfaces requires the use of hydrophobic surfactants (usually, but not limited to, nonionic surfactants) and/or hydrophobic solvents.

In accordance with the present invention, there is provided laundry cleaning compositions combining the chemical cleaning (bleaching) ability of hydrogen peroxide with the physical cleaning ability of hydrophobic solvents. The compositions are dry formulated at a pH level enhancing the capability of the hydrogen peroxide to bleach the fabrics and textiles to which they are applied. The enhancing pH level exceeds approximately 9.

Another object of the present invention is to provide formulations containing peroxides and hydrophobic solvents or surfactants in a powdered matrix which when combined with water are buffered at a pH greater than about 9.

DETAILED DESCRIPTION OF THE INVENTION

The present invention features compositions providing improved cleaning efficacy for all types and colors of fabrics, as well as extending the range and types of stains and dirt commonly treated by present day commercial laundry compositions.

The compositions of this invention incorporate both a source of hydrogen peroxide and a solvent or surfactant in a dry formulation where the pH level exceeds approximately 9.0 (when the composition is combined with water) in order to maximize the bleaching power of hydrogen peroxide. Any suitable alkaline substance may be used to achieve the desired pH, including sodium carbonate. The pH may be adjusted depending on the desired application, but will generally be above 8.5, desirably above about 8.75, and more desirably above about 9. Compositions which achieve a pH of higher than about 10 when combined with water are also included.

A major disadvantage of previous liquid compositions containing peroxide is their instability. This is particularly true of the liquid composition when hydrogen peroxide is mixed with terpenes. Such liquid combination can only be formulated at a low pH, i.e., less than 8. However, the effectiveness of hydrogen peroxide as a bleaching agent increases dramatically as the pH level rises above 9.5.

The improved efficacy as a bleaching agent in this elevated pH range is believed to be due to the fact that at this higher pH level there is broader based bleaching. The hydrogen peroxide can bleach not only as an oxidizing/reducing agent, but also as a powerful nucleophilic agent via the hydroperoxide anion. This nucleophilic anion has been found in appreciable quantities at pH levels from above about 9.5 and higher. Any suitable alkaline substance may be used to achieve the desired pH, including, but not limited to, sodium carbonate ($Na_2CO_3$).

One of the major advantages of the formulations of the present invention is their ability to be directly applied in paste form to fabrics such as clothes and carpets. The dry formulations can be mixed with a little water to form this paste, and the paste can be gently applied to the fabric surface. The high pH level provides excellent bleaching action to stains. Additionally, fatty acid-based stains, which constitute a common source of oily stains in laundry textiles, are more readily removed from surfaces at pH levels above about 9.

It has also been discovered that the hydrogen peroxide source remains stable over long periods of time at a broad range of temperatures within the dry composition. This is especially surprising, since the presence of moisture would be expected to lead to rapid decomposition of the hydrogen peroxide source.

The hydrogen peroxide source may include one or more compounds which form hydrogen peroxide when exposed to water. These include without limitation sodium perborate tetrahydrate, sodium perborate monohydrate, sodium percarbonate monohydrate, sodium percarbonate tetrahydrate, sodium persulfate, and combinations thereof. These compounds may further be encapsulated with a suitable water soluble polymer or inorganic salts which would release the compound upon exposure to water. The encapsulation may be achieved by any means known in the art such as extrusion with the encapsulating polymer or by spray coating.

The solvent included in the present invention may be selected from a broad range of solvents known to those skilled in the art. The solvent may also be classified as a surfactant, desirably a non-ionic surfactant. The solvents which are useful with the present invention fall into three main categories: (a) solvents which are substantially immiscible in water (and may or may not be additionally solubilized upon the addition of emulsifying surfactants), (b) solvents which are slightly immiscible in water, (c) solvents which are miscible in water, and combinations thereof. The emulsifying surfactants may be any surfactant which is known in the art for that purpose. Ideally, combinations of one or more solvents from each of the different categories which have different physiochemical properties are combined to increase the variety of stains which are removed from the composition. For example, desirable combinations of solvents include without limitation, a solvent from group (a) and a solvent from group (b), a solvent from group (a) and a solvent from group (c), a solvent from group (b) and a solvent from group (c), or a solvent each from groups (a), (b), and (c).

The solvent or surfactant may be included in any suitable amount, for example from about 0.5 to about 30, desirably from about 0.5 to about 20, and more desirably from about 0.5 to about 15.

Many of the solvents which are included in group (a) are desirable as being considered low V.O.C. (volatile organic compound) or non-V.O.C. by various governmental agencies. Solvents in group (a) which exhibit increased solubility in the presence of emulsifying surfactants include, without limitation, terpenes including d-limonine, 1-limonine, dipentene, α-pinene, β-pinene. Also included are alkyl esters of natural oils, plant oils, and fatty acid esters such as soybean oil, canola oil, coconut oil, sunflower oil, cottonseed oil, peanut oil, corn oil, tall oil fatty acids, oleic acid, linoleic acid, linolenic acid, steric acid, and palmitic acid. Specific examples include methylated soybean oil, methylated canola oil, methylated coconut oil, etc.

Examples of solvents of group (a) which are immiscible in water even after combination with emulsifying surfactants include petroleum hydrocarbons and paraffinic hydrocarbons.

The solvents of group (b) are those which are slightly miscible in water, but are increasingly solubilized with the addition of surfactant emulsifiers. These include the entire class of glycol ethers, including but not limited to, ditheylene glycol monobutyl ether, diethylene glycol monoethyl ether, diethylene glycol monomethyl ether, dipropylene glycol monopropyl ether, ethylene glycol monobutyl ether, ethylene glycol monoethyl ether, propylene glycol monomethyl ether and tripropylene glycol monomethyl ether.

The solvents of group (c) are those which are readily miscible in water. This includes lower molecular weight (i.e., one to 12 carbon atoms, $C_{1-12}$) alcohols (e.g., methanol, ethanol, and isopropanol), ketones (e.g., acetone), low molecular weight esters (e.g., ethyl acetate, and ethyl lactate), and organic amines (e.g., N-methyl pyrrolidone).

Examples of other useful solvents or surfactants which may be used with the present invention are disclosed in U.S. Pat. No. 6,451,339 B2 and U.S. Patent Publication No. 2002/0107149 A1, both of which are herein incorporated by reference in their entirety.

Although the compositions described herein are primarily directed to laundry cleaning, these compounds have additional use as cleaners for hard surfaces such as tile, grout, ceramics, porcelain, plastics, fiberglass, carpets, upholstery, concrete, wood decks, etc.

Another aspect of this invention is improved stain removal on a broad range of stain types, including oil and grease, fruit and vegetable, enzymatic, such as grass and blood, and particulate-based gray and mud/clay stains.

A variety of additives may also be included in the present invention as known in the art which are frequently found in laundry cleaning compositions. These include, without limitation, soil release polymers, polymeric dispersants, polysaccharides, abrasives, bactericides, tarnish inhibitors, builders, enzymes, opacifiers, dyes, buffers, antifungal or mildew control agents, insect repellents, perfumes or fragrances, hydrotropes, thickeners, processing aids, suds boosters, brighteners, anti-corrosive aids, stabilizers antioxidants and chealants. Examples of suitable additives (as well as other useful solvents) are disclosed in U.S. Pat. No. 6,756,351, herein incorporated by reference in its entirety.

Oil- and Grease-dissolving Substances

Examples of useful oil dissolving substances include components which have a positive effect on the ability to wash oil and grease out of textiles. Preferred oil- and grease-dissolving components include, for example, nonionic cellulose ethers, such as methylcellulose and methylhydroxypropylcellulose having a proportion of methoxy groups of from 15 to 30% by weight and of hydroxypropoxy groups of from 1 to 15% by weight, in each case based on the nonionic cellulose ethers, and the polymers, such as phthalic acid and/or of terephthalic acid, or of derivatives thereof, in particular polymers of ethylene terephthalates and/or polyethylene glycol terephthalates or anionically and/or nonionically modified derivatives thereof. Of these, particular preference is given to the sulfonated derivatives of phthalic acid and of terephthalic acid polymers.

Enzymes and Enzyme Stabilizers

Suitable enzymes include those from the class of hydrolases, such as proteases, esterases, lipases or enzymes with lipolytic action, amylases, cellulases or other glycosylhydrolases and mixtures of said enzymes. All of these hydrolases may contribute during washing to the removal of stains, such as protein, grease or starchy stains, and redeposition. Cellulases and other glycosyl hydrolases may, by removing pilling and microfibrils, contribute to color retention and to an increase in the softness of the textile. For bleaching or for inhibiting color transfer, it is also possible to use oxidoreductases. Particularly suitable enzymatic active ingredients are those obtained from bacterial strains or fungi, such as *Bacillus subtilis, Bacillus licheniformis, Streptomyces griseus* and *Humicola insolens*. Examples may include enzyme mixtures, for example mixtures of protease and amylase or protease and lipase or lipolytic enzymes, or protease and cellulase or of cellulase and lipase or lipolytic enzymes or of protease, amylase and lipase or lipolytic enzymes or protease, lipase or lipolytic enzymes and cellulase, in particular, however, protease- and/or lipase-containing mixtures or mixtures containing lipolytic enzymes. Examples of such lipolytic enzymes are the known cutinases. Peroxidases or oxidases have also proven suitable in some cases. Suitable amylases include, in particular, α-amylases, isoamylases, pullulanases and pectinases. The cellulases used are preferably cellobiohydrolases, endoglucanases and β-glucosidases, which are also called cellobiases, or mixtures thereof. Since the various cellulase types differ in their CMCase and avicelase activities, it is possible to adjust the desired activities through targeted mixing of the cellulases.

Antiredeposition Agents

Antiredeposition agents have the task of keeping the soil detached from the fiber in suspended form in the liquor, and thus preventing reattachment of the soil. For this purpose, water-soluble colloids of a mostly organic nature are suitable, for example the water-soluble salts of polymeric carboxylic acids, glue, gelatin, salts of ether carboxylic acids or ether sulfonic acids of starch or of cellulose or salts of acidic sulfuric esters of cellulose or of starch. Water-soluble polyamides which contain acidic groups are also suitable for this purpose. In addition, it is also possible to use soluble starch preparations, and starch products other than those mentioned above, e.g. degraded starch, aldehyde starches etc. Polyvinyl-pyrrolidone can also be used. Also included are cellulose ethers, such as carboxymethyl-cellulose (Na salt), methylcellulose, hydroxyalkyl-cellulose and mixed ethers, such as methylhydroxyethyl-cellulose, methylhydroxypropylcellulose, methyl-carboxymethylcellulose and mixtures thereof, and polyvinylpyrrolidone.

Optical Brighteners

The compositions can include derivatives of diaminostilbenedisulfonic acid, or alkali metal salts thereof, as optical brighteners. For example, salts of 4,4'-bis(2-anilino-4-morpholino-1,3,5-triazinyl-6-amino)stilbene-2,2'-disulfonic acid or compounds constructed in a similar way which carry a diethanolamino group, a methylamino group, an anilino group or a 2-methoxyethylamino group instead of the morpholino group are suitable. Brightners of the substituted diphenylstyryl type may also be present, e.g. the alkali metal salts of 4,4'-bis(2-sulfostyryl)diphenyl, 4,4'-bis(4-chloro-3-sulfostyryl)-diphenyl, or 4-(4-chlorostyryl)-4'-(2-sulfostyryl)-diphenyl. Mixtures of the abovementioned brighteners may also be used.

Polymers

Suitable soil-repellent polymers are those which preferably contain ethylene terephthalate and/or polyethylene glycol terephthalate groups, where the molar ratio of ethylene terephthalate to polyethylene glycol terephthalate may be in the range from 50:50 to 90:10. The molecular weight of the linking polyethylene glycol units may be in the range from 750 to 5000, i.e. the degree of ethoxylation of the polyethylene glycol group-containing polymers may be about 15 to 100. The polymers are characterized by an average molecular weight of about 5000 to 200,000 and can have a block structure, but preferably have a random structure. Specific examples of polymers are those with ethylene terephthalate/polyethylene glycol terephthalate molar ratios of from about 65:35 to about 90:10, preferably from about 70:30 to 80:20. Also included are those polymers which have linking polyethylene glycol units with a molecular weight of from 750 to 5000, preferably from 1000 to about 3000 and a molecular weight of the polymer from about 10 000 to about 50 000. Examples of commercially available polymers are the products Milease.RTM. T (ICI) or Repelotex.RTM. SRP 3 (Rhone-Poulenc).

Defoamers

Defoamers which can be used are wax-like compounds. "Wax-like" is to be understood as meaning those compounds which have a melting point at atmospheric pressure above 25° C. (room temperature), preferably above 50° C. and in particular above 70° C. The wax-like defoamer substances are virtually insoluble in water, i.e. at 20° C. they have a solubility below 0.1% by weight in 100 g of water. In principle, all wax-like defoamer substances known from the prior art may be present. Suitable wax-like compounds are, for example, bisamides, fatty alcohols, fatty acids, carboxylic esters of mono- and polyhydric alcohols, and paraffin waxes or mixtures thereof. Alternatively, the silicone compounds known for this purpose can of course also be used.

Suitable bisamides as defoamers are those which are derived from saturated fatty acids having 12 to 22, preferably 14 to 18, carbon atoms, and from alkylenediamines having 2 to 7 carbon atoms. Suitable fatty acids are lauric acid, myristic acid, stearic acid, arachidic acid and behenic acid, and mixtures thereof, as are obtainable from natural fats or hydrogenated oils, such as tallow or hydrogenated palm oil. Suitable diamines are, for example, ethylenediamine, 1,3-propylenediamine, tetramethylenediamine, pentamethylenediamine, hexamethylenediamine, p-phenylenediamine and tolylenediamine. Preferred diamines are ethylenediamine and hexamethylenediamine. Particularly preferred bisamides are bismyristoylethylenediamine, bispalmitoylethylenediamine, bis-stearoylethylenediamine and mixtures thereof, and the corresponding derivatives of hexamethylenediamine.

Suitable carboxylic esters as defoamers are derived from carboxylic acids having 12 to 28 carbon atoms; in particular, these are esters of behenic acid, stearic acid, hydroxystearic acid, oleic acid, palmitic acid, myristic acid and/or lauric acid. The alcohol moiety of the carboxylic ester comprises a mono- or polyhydric alcohol having from 1 to 28 carbon atoms in the hydrocarbon chain. Examples of suitable alcohols are behenyl alcohol, arachidyl alcohol, cocoyl alcohol, 12-hydroxystearyl alcohol, oleyl alcohol and lauryl alcohol, and also ethylene glycol, glycerol, polyvinyl alcohol, sucrose, erythritol, pentaerythritol, sorbitan and/or sorbitol. Preferred esters are those of ethylene glycol, glycerol and sorbitan, where the acid moiety of the ester is, in particular, chosen from behenic acid, stearic acid, oleic acid, palmitic acid or myristic acid. Suitable esters of polyhydric alcohols are, for example, xylitol monopalmitate, pentaerythritol monostearate, glycerol monostearate, ethylene glycol monostearate and sorbitan monostearate, sorbitan palmitate, sorbitan monolaurate, sorbitan dilaurate, sorbitan distearate, sorbitan dibehenate, sorbitan dioleate, and mixed tallow alkyl sorbitan monoesters and diesters. Glycerol esters which can be used are the mono-, di- or triesters of glycerol and said carboxylic acids, preference being given to the mono- or diesters. Glycerol monostearate, glycerol monooleate, glycerol monopalmitate, glycerol monobehenate and glycerol distearate are examples thereof. Examples of suitable natural esters as defoamers are beeswax, which consists primarily of the esters $CH_3(CH_2)_{24}COO(CH_2)_{27}CH_3$ and $CH_3(CH_2)_{26}COO(CH_2)_{25}CH_3$, and carnauba wax, which is a mixture of carnaubic acid alkyl esters, often in combination with small amounts of free carnaubic acid, further long-chain acids, high molecular weight alcohols and hydrocarbons.

Suitable carboxylic acids as further defoamer compound include behenic acid, stearic acid, oleic acid, palmitic acid, myristic acid and lauric acid, and mixtures thereof as are obtainable from natural fats or optionally hydrogenated oils, such as tallow or hydrogenated palm oil. More specifically are saturated fatty acids having 12 to 22, in particular 18 to 22, carbon atoms. In the same manner, the corresponding fatty alcohols of equal carbon chain length can be used.

In addition, dialkyl ethers may additionally be present as defoamers. The ethers may have an asymmetrical or symmetrical structure, i.e. contain two identical or different alkyl chains, preferably having 8 to 18 carbon atoms. Typical examples are di-n-octyl ether, di-isooctyl ether and di-n-stearyl ether. Dialkyl ethers which have a melting point above 25° C., in particular above 40° C. are particularly suitable. Further suitable defoamer compounds are fatty ketones, which can be obtained in accordance with the relevant methods of preparative organic chemistry. They are prepared, for example, starting from carboxylic acid magnesium salts, which are pyrolyzed at temperatures above 300° C. with elimination of carbon dioxide and water, for example in accordance with German laid-open specification DE 2553900 A. Suitable fatty ketones are those which are prepared by pyrolysis of the magnesium salts of lauric acid, myristic acid, palmitic acid, palmitoleic acid, stearic acid, oleic acid, elaidic acid, petroselic acid, arachidic acid, gadoleic acid, behenic acid or erucic acid.

Further suitable defoamers are fatty acid polyethylene glycol esters, which are preferably obtained by homogeneous base-catalyzed addition reaction of ethylene oxide with fatty acids. In particular, the addition reaction of ethylene oxide with the fatty acids is carried out in the presence of alkanolamines as catalysts. The use of alkanolamines, specifically triethanolamine, leads to an extremely selective ethoxylation of the fatty acids, particularly when the aim is to prepare compounds which have a low degree of ethoxylation.

Within the group of wax-like defoamers, the paraffin waxes described used alone as wax-like defoamers, or in a mixture with one of the other wax-like defoamers, where the proportion of paraffin waxes in the mixture preferably constitutes more than 50% by weight, based on wax-like defoamer mixture. Suitable carrier materials are all known inorganic and/or organic carrier materials. Examples of typical inorganic carrier materials are alkali metal carbonates, aluminosilicates, water-soluble phyllosilicates, alkali metal silicates, alkali metal sulfates, for example sodium sulfate, and alkali metal phosphates. The alkali metal silicates are preferably a compound with an alkali metal oxide to $SiO_2$ molar ratio of from 1:1.5 to 1:3.5. The use of such silicates results in particularly good particle properties, in particular high abrasion stability and nevertheless a high dissolution rate in water. The aluminosilicates referred to as carrier material include, in particular, the zeolites, for example zeolite NaA and NaX. The compounds referred to as water-soluble phyllosilicates include, for example, amorphous or crystalline water glass. In addition, it is possible to use silicates which are available commercially under the name Aerosil.RTM. or Sipernat.RTM. Suitable organic carrier materials are, for example, film-forming polymers, for example polyvinyl alcohols, polyvinylpyrrolidones, poly (meth)acrylates, poly-carboxylates, cellulose derivatives and starch. Cellulose ethers which can be used are, in particular, alkali metal carboxymethylcellulose, methylcellulose, ethylcellulose, hydroxyethylcellulose and cellulose mixed ethers, such as, for example, methylhydroxyethylcellulose and methylhydroxypropylcellulose, and mixtures thereof. Particularly suitable mixtures are composed of sodium carboxymethylcellulose and methyl-cellulose, where the carboxymethylcellulose usually has a degree of substitution of from 0.5 to 0.8 carboxy-methyl groups per anhydroglucose unit and the methyl-cellulose has a degree of substitution of from 1.2 to 2 methyl groups per anhydroglucose unit. More specifically, may include alkali metal carboxymethylcellulose and nonionic cellulose ethers in weight ratios of from 80:20 to 40:60, in particular from 75:25 to 50:50. A suitable carrier is also natural starch which is composed of amylose and amylopectin. Natural starch is the term used to describe starch such as is available as an extract from natural sources, for example from rice, potatoes, corn and wheat. Natural starch is a commercially available product and thus readily available. As carrier materials it is possible to use one or more of the compounds mentioned above, in particular chosen from the group of alkali metal carbonates, alkali metal sulfates, alkali metal phosphates, zeolites, water-soluble phyllosilicates, alkali metal silicates, polycarboxylates, cellulose ethers, polyacrylate/polymethacrylate and starch. Particularly suitable mixtures are those of alkali metal carbonates, in particular sodium carbonate, alkali metal silicates, in particular sodium silicate, alkali metal sulfates, in particular sodium sulfate and zeolites.

Suitable silicones are customary organopolysiloxanes which may have a content of finely divided silica, which in turn may also be silanized. Such organo-polysiloxanes are described, for example, in European patent application EP 0496510 A1. Included are polydiorganosiloxanes and, in particular, polydimethylsiloxanes which are known in the art. Suitable polydiorganosiloxanes have a virtually linear chain and have a degree of oligomerization of from 40 to 1500. Examples of suitable substituents are methyl, ethyl, propyl, isobutyl, tert-butyl and phenyl. Also suitable are amino-, fatty acid-, alcohol-, polyether-, epoxy-, fluorine-, glycoside- and/or alkyl-modified silicone compounds, which may either be liquid or in resin form at room temperature. Also suitable are simethicones, which are mixtures of dimethicones having an average chain length of from 200 to 300 dimethylsiloxane units and hydrogenated silicates. As a rule, the silicones generally, and the polydiorganosiloxanes in particular, contain finely divided silica, which may also be silanized. For the purposes of the present invention, silica-containing dimethylpolysiloxanes are particularly suitable. The polydiorganosiloxanes have a Brookfield viscosity at 25° C. (spindle 1, 10 rpm) in the range from 5000 mPas to 30,000 mPas, in particular from 15,000 to 25,000 mPas. The silicones are desirably used in the form of their aqueous emulsions. The silicone is generally added to an initial charge of water with stirring. If desired, in order to increase the viscosity of the aqueous silicone emulsions, it is possible to add thickeners, as are known from the prior art. These may be inorganic and/or organic in nature, and particular preference is given to nonionic cellulose ethers, such as methylcellulose, ethylcellulose and mixed ethers, such as methylhydroxyethylcellulose, methylhydroxypropylcellulose, methylhydroxybutylcellulose, and anionic carboxycellulose products, such as carboxymethylcellulose sodium salt (abbreviation CMC). Particularly suitable thickeners are mixtures of CMC to nonionic cellulose ethers in the weight ratio 80:20 to 40:60, in particular 75:25 to 60:40. Usually, and particularly in the case of the addition of the described thickener mixtures, concentrations may be from about 0.5 to 10% by weight, in particular from 2.0 to 6% by weight, calculated as thickener mixture and based on aqueous silicone emulsion. The content of silicones of the type described in the aqueous emulsions is advantageously in the range from 5 to 50% by weight, in particular from 20 to 40% by weight, calculated as silicones and based on aqueous silicone emulsion. According to a further advantageous embodiment, the aqueous silicone solutions receive, as thickener, starch accessible from natural sources, for example from rice, potatoes, corn and wheat. The starch is advantageously present in amounts of from 0.1 up to 50% by weight, based on silicone emulsion and, in particular, in a mixture with the already described thickener mixtures of sodium carboxymethylcellulose and a nonionic cellulose ether in the amounts already given.

Disintegrants

The solid preparations can further include disintegrants. This term is to be understood as meaning substances which are added to the shaped bodies in order to accelerate their disintegration upon contact with water. Overviews on this subject can be found, for example, in J. Pharm. Sci. 61 (1972), Rompp Chemilexikon, 9.sup.th Edition, Volume 6, p. 4440 and Voigt "Lehrbuch der pharmazeutischen Technologie" [Textbook of Pharmaceutical Technology] (6th Edition, 1987, pp. 182-184). These substances increase in volume upon ingress of water, with on the one hand an increase in the intrinsic volume (swelling) and on the other hand, by way of release of gases as well, the possibility of generating a pressure which causes the tablet to disintegrate into smaller particles. Examples of established disintegration auxiliaries are carbonate/citric acid systems, with the use of other organic acids also being possible. Examples of swelling disintegration auxiliaries are synthetic polymers such as optionally crosslinked polyvinylpyrrolidone (PVP) or natural polymers and/or modified natural substances such as cellulose and starch and their derivatives, alginates or casein derivatives. Examples of disintegrants include disintegrants based on cellulose. Pure cellulose has the formal gross composition $(C_6H_{10}O_5)_n$ and, considered formally, is a β-1,4-polyacetal of cellobiose, which itself is constructed from two molecules of glucose. Suitable celluloses consist of about 500 to 5000 glucose units and, accordingly, have average molar masses of from 50,000 to 500,000. Cellulose-based disintegrants which can be used for the purposes of the present invention are also cellulose derivatives obtainable by polymer-analogous reactions from cellulose. Such chemically modified celluloses include, for example, products of esterifications and etherifications in which hydroxyl hydrogen atoms have been substituted. However, celluloses in which the hydroxyl groups have been replaced by functional groups not attached via an oxygen atom may also be used as cellulose derivatives. The group of cellulose derivatives includes, for example, alkali metal celluloses, carboxymethylcellulose (CMC), cellulose esters and ethers and also aminocelluloses. Said cellulose derivatives are preferably not used alone as cellulose-based disintegrants, but instead are used in a mixture with cellulose. The cellulose derivative content of these mixtures is preferably less than 50% by weight, particularly preferably less than 20% by weight, based on the cellulose-based disintegrant. A particularly preferred cellulose-based disintegrant used is pure cellulose which is free from cellulose derivatives. A further cellulose-based disintegrant, or constituent of this component, which may be used is microcrystalline cellulose. This microcrystalline cellulose is obtained by partial hydrolysis of celluloses under conditions which attack only the amorphous regions (approximately 30% of the total cellulose mass) of the celluloses and break them up completely, but leave the crystalline regions (about 70%) intact. Subsequent deaggregation of the microfine celluloses resulting from the hydrolysis yields the microcrystalline celluloses, which have primary particle sizes of approximately 5 μm and can be compacted, for example, to give granulates having an average particle size of 200 μm. The disintegrants can, viewed macroscopically, be homogeneously distributed within the shaped body, but, viewed microscopically, form zones of increased concentration as a result of the preparation. Disintegrants which may be present for the purposes of the invention, such as, for example, kollidon, alginic acid and alkali metal salts thereof, amorphous and also partially crystalline phyllosilicates (bentonites), polyacrylates, polyethylene glycols are given, for example, in the printed specifications WO 98/40462 (Rettenmaier), WO 98/55583 and WO 98/55590 (Unilever) and WO 98/40463, DE 19709991 and DE 19710254 A1 (Henkel), all of which are herein incorporated by reference. The shaped bodies can comprise the disintegrants in amounts of from 0.1 to 25% by weight, preferably 1 to 20% by weight and in particular 5 to 15% by weight, based on the shaped bodies.

Fragrances

Perfume oils or fragrances which can be used are individual fragrance compounds, e.g. the synthetic products of the ester, ether, aldehyde, ketone, alcohol and hydrocarbon type. Fragrance compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate and benzyl salicylate. The ethers include, for example, benzyl ethyl ether; the aldehydes include, for example, the linear alkanals having 8-18 carbon atoms, citral, citronellal, citronellyloxyacetaldehyde, cyclamen aldehyde, hydroxycitronellal, lillial and bourgeonal; the ketones include, for example, the ionones, .alpha.-isomethylionone and methyl cedryl ketone; the alcohols include anethole, citronellol, eugenol, geraniol, linalool, phenylethyl alcohol and terpineol. Such perfume oils can also comprise natural fragrance mixtures, such as are obtainable from vegetable sources, e.g. pine oil, citrus oil, jasmine oil, patchouli oil, rose oil or ylang ylang oil. Likewise suitable are muscatel, sage oil, camomile oil, clove oil, balm oil, mint oil, cinnamon leaf oil, lime blossom oil, juniper berry oil, vetiver oil, olibanum oil, galbanum oil and labdanum oil, and orange blossom oil, neroli oil, orange peel oil and sandalwood oil.

The fragrances can be incorporated directly into the compositions according to the invention, although it is also advantageous to apply the fragrances to carriers which enhance the adhesion of the perfume to the laundry and, as a result of a slower release of fragrance, ensure long-lasting fragrance of the textiles. Cyclodextrins have, for example, proven successful as such carrier materials, where the cyclodextrin-perfume complexes can also additionally be coated with further auxiliaries.

Inorganic Salts

Further suitable ingredients of the compositions are water-soluble inorganic salts, such as bicarbonates, carbonates, amorphous silicates, which do not have prominent builder properties, or mixtures thereof; in particular, alkali metal carbonate and/or amorphous alkali metal silicate, primarily sodium silicate with an $Na_2O:SiO_2$ molar ratio of from 1:1 to 1:4.5, preferably from 1:2 to 1:3.5, are used. The content of sodium silicate (without particular builder properties) when present in the compositions is generally up to 10% by weight and preferably between 1 and 8% by weight. Fillers and extenders which may be present are also, for example, sodium sulfate in amounts of from 0 to 10% by weight, in particular 1 to 5% by weight, based on compositions.

Foaming

If high sudsing is desired, suds boosters such as the $C_{10}$-$C_{16}$ alkanolamides can be incorporated into the compositions, typically at 1%-10% levels. The $C_{10}$-$C_{14}$ monoethanol and diethanol amides illustrate a typical class of such suds boosters. Use of such suds boosters with high sudsing adjunct surfactants such as the amine oxides, betaines and sultaines noted above is also advantageous The features and advantages of the present invention are more fully shown by the following examples which are provided for purposes of illustration, and are not to be construed as limiting the invention in any way.

EXAMPLES

Example 1

| All Purpose Cleaning Additive Product | % by weight |
|---|---|
| $Na_2CO_3$ | 10-50 |
| Sodium Perborate or Percarbonate, (each as a monohydrate or tetrahydrate) | 8-60 |
| Alkylated plant oil | 0.5-20 |
| Fragrance | 0.1-2.0 |
| Emulsifying Surfactants | 1.0-15.0 |
| Chelating Agents | 0.2-5.0 |

Example 2

| Laundry Detergent Powder | % by weight |
|---|---|
| $Na_2CO_3$ | 10-50 |
| Sodium Tripolyphosphate | 1-20 |
| Anti-Redeposition Agents | 0-2 |
| Sodium Metasilicate | 1-10 |
| Fabric Brightening Agents | 0.1-2.0 |
| Terpene | 0.5-10 |
| Glycol ether | 0.5-10 |
| Fragrances | 0.1-2.0 |
| Emulsifying Surfactants | 1.0-15.0 |
| Sodium Perborate or Percarbonate (each as a monohydrate or a tetrahydrate) | 8-60 |

-continued

| Laundry Detergent Powder | % by weight |
|---|---|
| Sodium Hydroxide | 1-10.0 |
| Chelating Agents | 0.2-5.0 |

Example 3

| Laundry Detergent Powder | % by weight |
|---|---|
| $Na_2CO_3$ | 10-50 |
| Sodium Tripolyphosphate | 1-20 |
| Anti-Redeposition Agents | 0-2 |
| Sodium Metasilicate | 1-10 |
| Fabric Brightening Agents | 0.1-2.0 |
| Methylated Soybean Oils | 0.5-20 |
| Glycol ether | 0.5-10 |
| Fragrances | 0.1-2.0 |
| Emulsifying Surfactants | 1.0-15.0 |
| Sodium Perborate or Percarbonate (each as a monohydrate or a tetrahydrate) | 8-60 |
| Sodium Hydroxide | 1-10.0 |
| Chelating Agents | 0.2-5.0 |

Example 4

| All Purpose Cleaning Additive Product | % by weight |
|---|---|
| Soda Ash | 10-70 |
| Sodium Perborate or Percarbonate (each as a monohydrate or tetrahydrate) | 8-60 |
| Terpene | 0.5-20 |
| Fragrance | 0.1-2.0 |
| Anionic Surfactant | 0.5-5.0 |
| Nonionic Surfactant | 0.5-5.0 |
| Chelating Agents | 0.2-5.0 |

Example 5

| Laundry Detergent Power | % by weight |
|---|---|
| Soda Ash | 1-40 |
| Sodium Tripolyphosphate | 1-20 |
| Anti-Redposition Agents | 0-2 |
| Sodium Metasilicate | 1-10 |
| Fabric Brightening Agents | 0.1-2.0 |
| Terpenes | 0.5-20 |
| Fragrances | 0.1-2.0 |
| Nonionic Surfactants | 0.5-5.0 |
| Anionic Surfactants | 0.5-5.0 |
| Amphoteric Surfactants | 0.5-5.0 |
| Sodium Perborate or Percarbonate (each as a monohydrate or a tetrahydrate) | 8-60 |
| Sodium Hydroxide | 1-10.0 |
| Chelating Agents | 0.2-5.0 |

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

The invention claimed is:

1. A cleaning composition consisting of:

| Component | % by weight |
|---|---|
| $Na_2CO_3$ | 10-50 |
| Sodium Tripolyphosphate | 0.5-5.0 |
| Fabric Brightening Agents | 0.1-0.5 |
| Methylated Soybean Oil | 0.5-30.0 |
| Fragrances | 0.1-1.0 |
| Emulsifying surfactants | 1.0-15.0 |
| Sodium Percarbonate | 8-60. |

2. A composition according to claim 1, wherein said composition has a pH greater than about 8.75 when combined with water.

3. A composition according to claim 1, wherein said composition has a pH greater than about 9 when combined with water.

4. A composition according to claim 1, wherein said composition has a pH greater than about 10 when combined with water.

5. A laundry detergent powder consisting of:

| Component | % by weight |
|---|---|
| $Na_2CO_3$ | 10-50 |
| Sodium Tripolyphosphate | 1-20 |

-continued

| Component | % by weight |
|---|---|
| Anti-Redeposition Agents | 0-2 |
| Sodium Metasilicate | 1-10 |
| Fabric Brightening Agents | 0.1-2.0 |
| Terpene | 0.5-10 |
| Glycol ether | 0.5-10 |
| Fragrances | 0.1-2.0 |
| Emulsifying Surfactants | 1.0-15.0 |
| Sodium Perborate or Percarbonate (each as a monohydrate or a tetrahydrate) | 8-60 |
| Sodium Hydroxide | 1-10.0 |
| Chelating Agents | 0.2-5.0. |

6. A laundry detergent powder consisting of:

| Component | % by weight |
|---|---|
| $Na_2CO_3$ | 10-50 |
| Sodium Tripolyphosphate | 1-20 |
| Anti-Redeposition Agents | 0-2 |
| Sodium Metasilicate | 1-10 |
| Fabric Brightening Agents | 0.1-2.0 |
| Methylated Soybean Oils | 0.5-20 |
| Glycol ether | 0.5-10 |
| Fragrances | 0.1-2.0 |
| Emulsifying Surfactants | 1.0-15.0 |
| Sodium Perborate or Percarbonate (each as a monohydrate or a tetrahydrate) | 8-60 |
| Sodium Hydroxide | 1-10.0 |
| Chelating Agents | 0.2-5.0. |

* * * * *

UNITED STATES PATENT AND TRADEMARK OFFICE

CERTIFICATE OF CORRECTION

PATENT NO. : 7,368,418 B2
APPLICATION NO. : 11/026137
DATED : May 6, 2008
INVENTOR(S) : Diamond et al.

It is certified that error appears in the above-identified patent and that said Letters Patent is hereby corrected as shown below:

ON THE TITLE PAGE ITEM 74:

now reads "Hoffman"
should read --Hoffmann--;

Signed and Sealed this

Seventh Day of October, 2008

JON W. DUDAS
*Director of the United States Patent and Trademark Office*